United States Patent [19]

Woods

[11] 4,372,550

[45] Feb. 8, 1983

[54] AIR FLOW DELIVERY SYSTEM

[76] Inventor: Kenneth D. Woods, 3158 Aurora Vista Dr., Spring Valley, Calif. 92077

[21] Appl. No.: 259,000

[22] Filed: Apr. 30, 1981

[51] Int. Cl.[3] ..... B65H 31/00

[52] U.S. Cl. ..... 271/211; 271/195

[58] Field of Search ..... 271/195, 211

[56] References Cited

U.S. PATENT DOCUMENTS

| | | | |
|---|---|---|---|
| 1,107,859 | 8/1914 | Stevens | 271/211 |
| 2,151,136 | 3/1939 | Moffitt | 271/175 |
| 2,769,495 | 11/1956 | Pomper et al. | 271/195 X |
| 2,796,259 | 6/1957 | Fawcett | 271/188 |
| 3,556,519 | 1/1971 | Keller | 271/211 X |
| 3,934,872 | 1/1976 | Honkawa | 271/188 |
| 4,062,536 | 12/1977 | Michelson | 271/177 |
| 4,168,831 | 9/1979 | Rebel | 271/195 X |

*Primary Examiner*—Richard A. Schacher

*Attorney, Agent, or Firm*—Brown & Martin

[57] ABSTRACT

A system for delivering and stacking sheets of paper into a receiving tray or chute from a processing machine, such as a printing machine and the like, includes sheet supporting air jets extending from the forward end of and along the length of the chute for supporting the side edges of the paper and air jets directly above the paper for bending the paper about its axis for longitudinal support of the paper to prevent roll and tumble of the sheet into the chute.

12 Claims, 4 Drawing Figures

AIR FLOW DELIVERY SYSTEM

BACKGROUND OF THE INVENTION

The present invention relates to paper processing and particularly to the delivery and stacking of sheets of paper into a chute.

The rate of production of printing machines such as lithographic presses and the like is limited by the speed with which the paper ejected from the machine can be received and stacked in chute or tray. The typical delivery system from an offset printing machine includes a chute open at the top and at one end and usually inclined at an angle such that sheets exiting from the machine are also directed downward at substantially the same angle to fall into the bottom of the chute or tray. The speed with which the chute can accept sheets of paper is then limited substantially by the rate at which the sheets can fall by gravity to the bottom of the chute. This rate is typically between about 6,000 and 7,500 sheets per hour for present machines. However, such machines are typically operated at about 5,000 per hour.

The sheets of paper enter the tray at a height that would be approximately the maximum limit of a stack in the tray when full. The sheet then falls to the bottom of the tray with the next sheet entering the chute at the same level and falling on top of the previous sheet and so on until the chute is full. Thus, the feeding into the chute is substantially limited to the gravity feed rate as the sheet falls downward from the machine. Of course, the sheet moves outward away from the machine under the inertia resulting from the speed with which it exited from the machine.

Other disadvantages of the systems are that the sheets tend to fall and slide across the present printed surface of the previous sheet. When the sheets are freshly printed, this can smear ink, especially on slick surfaced paper. Freshly printed sheets are also usually statically charged and tend to cling to one another.

Still other disadvantages of the prior art are that thin sheets of paper, such as onion skin and the like, tend to roll and tumble into the chute. This results in an immediate jam-up of paper in the chute, with the result that the machine must be shut down until the chute is cleared. Sheets which have been laminated by a coating of moisture also have a tendancy to bow or curl and roll into the chute jamming it. A chain delivery system which employs grippers on a chain which grip and pull each sheet out to a position above the tray and then releases it has been developed for this problem. These, however, have not been completely satisfactory.

It is frequently necessary to build up the bottom of the chute by a block or false bottom so that the sheets land and come to rest before they have a chance to curl and tumble, thus reducing the capacity of the chute so that it must be cleared more often.

Another disadvantage is that the tray must be set to a width greater than that of the paper, and paper will frequently fail to move completely to the end of the tray. Thus, the stack must then be removed and jolted or shook to jolt the edges of the sheets together for packaging.

Accordingly, it is desirable that some apparatus be available which enhances the speed and quality of the stacking of sheets of paper from a printing or other processing machine.

SUMMARY AND OBJECTS OF THE INVENTION

The primary object of the present invention is to provide an improved sheet delivery system for improving the stacking of sheets of paper in a printing or other paper processing machine chute or tray.

In accordance with the primary aspect of the present invention, a delivery system for controlling the delivery and stacking of sheets of paper into a chute or tray includes air support means for supporting the paper and air force means for forcing the center of the paper downward while supported to bow the paper about its longitudinal axis for support and rapid delivery of the paper into the chute.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
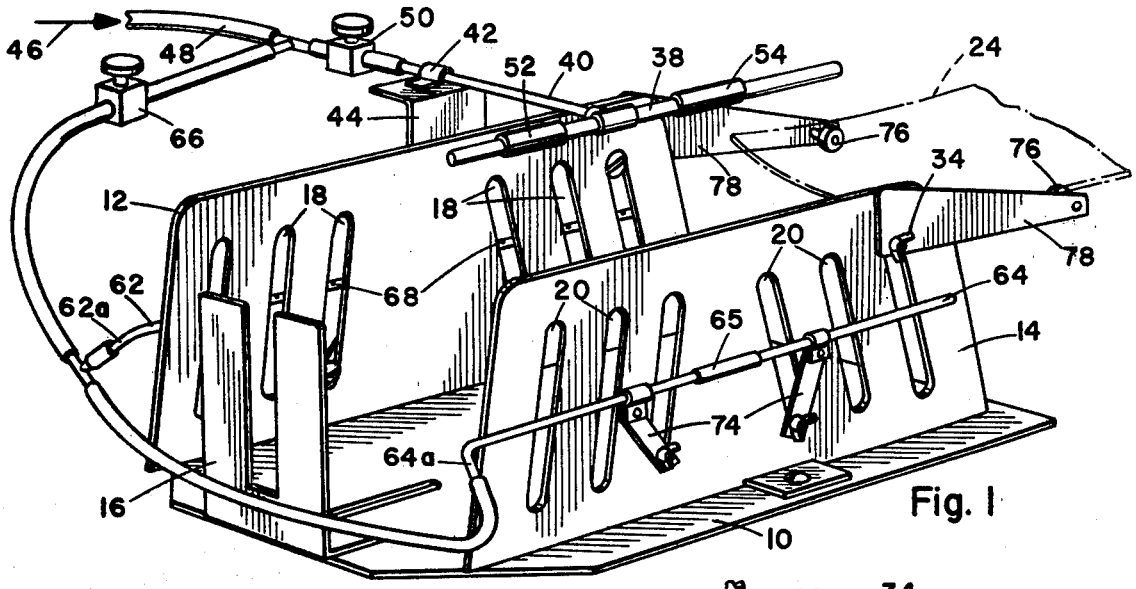
FIG. 1 is a perspective view of a typical chute with paper deflectors and the air support system installed.
Figure 2:
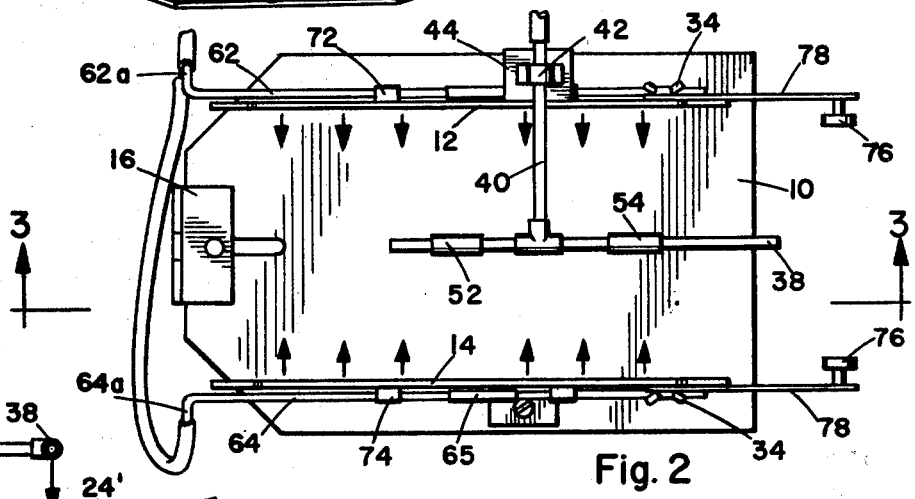
FIG. 2 is a top plan view of the structure of FIG. 1.

Turning now to the drawings, there is illustrated an improved delivery system in accordance with the present invention wherein a paper chute or tray is equipped with an air control delivery system in accordance with the invention.

Most printing and duplicating machines which print on single sheets of paper in succession, or at least deliver single sheets of paper in succession from the machine, typically deliver such sheets in a delivery chute or tray, such as illustrated in FIGS. 1 through 4. The tray includes a bottom or plate 10 having a pair of vertically extending side walls 12 and 14 secured thereto and extending upward for defining the sides of the chute. The side walls 12 and 14 are typically adjustable toward and away from one another for adjusting the size of paper that can be received within the chute. The chute in addition includes an end wall or stop member 16 for stopping the paper. The tray or chute is thus constructed to have an open front end into which the paper is received as shown, for example, in FIGS. 1 and 3. The end stop or gate 16 is typically adjustable along the axis of the chute for adjusting the length of paper that can be accepted within the machine.

The side walls 12 and 14 are substantially identical and each include a plurality of slots 18 and 20, which particularly in connection with the present invention, become vent slots. These slots also provide access by the support jets to the interior of the tray.

Figure 4:
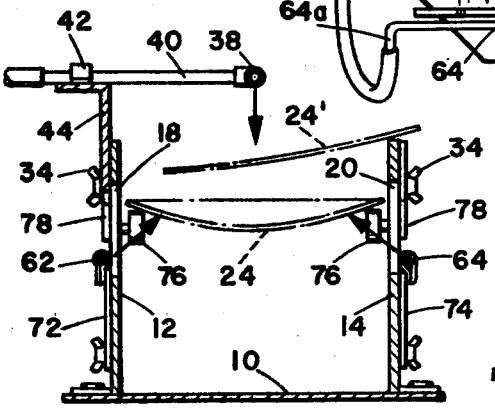
FIG. 4 is a sectional view taken on line 4—4 of FIG. 3.

As best seen in FIG. 4, the tray or chute is typically mounted at the exit of a machine, a portion of which is shown in phantom at 22. Sheets of paper 24 exiting from the machine are fed in succession into the chute. These sheets, as will be appreciated from FIG. 4, exit from the machine at substantially the same angle at the base or bottom of the chute and fall substantially by gravity downward to the end of the chute against the fence or stop 16 and on the bottom of the chute. The bottom of the chute may be inclined, or it may be level or horizontal, as shown. As will be appreciated when viewing FIG. 4 for example, a sheet exiting from the machine must fall by the force of gravity, away out of the way and interference of a succeeding sheet to prevent jamming or jam-up and blocking of the sheets entering the tray.

The invention herein was conceived to overcome the above problems by providing means for supporting the sheet along its edges at a greater distance into the tray or chute and at the same time provide means for applying pressure and force vertically downward on the sheet for bending or bowing the sheet about its longitudinal axis for self longitudinal support and as soon as the sheet is in position to simultaneously force the sheet downward into the bottom of the chute. This invention takes advantage of the fact that paper typically has a grain than runs along the longest dimension of the paper. When the paper is bent its longitudinal axis or around an axis parallel thereto, the paper will tend to have support along its length. Thus, bending the sheet about its longitudinal axis prevents the sheet from bending transverse to its axis and rolling or tumbling into the chute.

In carrying out the purpose of the present invention, apparatus comprises edge support means in the form of upwardly directed air jets along the sides of the chute in addition to a pair of lift or deflection guides 78, each comprising an elongated arm having an inwardly positioned guide roller 76 for supporting the side edges of the sheets from the exit rollers to the chute. These lift guides include an upper ramp surface extending to the top edges of the sidewalks 12 and 14. These are adjustably connected at one end by means of bolts and wing nuts 34, for ease of adjustment vertically. The wing nut and bolt assembly fits within the forward slots 18 and 20 of the respective side walls 12 and 14. In the typical construction, the heads of the screws are counter-sunk within the slots to avoid any interference with paper or sheets passing into the chute.

The guide members 78 extend outward forward of, and to each side of the open end of the chute for engaging just beneath the two sides of a sheet 24 as it exits from between the two pullout rollers 25 and 27 of the machine. This provides lateral support along the side edges for the sheet until it reaches the air support and clears the pullout rollers. The air support can be extended forward of the chute to begin support of the sheets earlier. In such instances, rollers 76 and the like, can in some cases, be eliminated.

A downward continuous pressure is then applied along the center of the sheet by a plurality of jets directed downward from an air tube 38 having a leg portion 40 secured such as by a clamp 42 to a bracket or the like or other suitable support structure 44, at the side of the chute. A suitable source of air (not shown) designated by the numeral 46, is connected by a conduit or the like 48 to the air tube 38. A suitable source of air is the exhaust from the vacuum system of the machine. Such machines are equipped with a vacuum system for operating the paper feed system for picking up the sheets of paper for feeding into the machine. A portion of the exhaust is used to separate the sheets of paper. Suitable valve means 50 is provided for controlling the volume of air fed to the tube 38 and thereby control the force applied to the upper surface of the sheets of paper. The force of the air on the top of the sheet can be varied to suit the requirements such as may result from sheet weight, stiffness or the like. The tube 38 extends along parallel to the axis of the tray directly above the position where the paper enters into the tray. A plurality of jets for directing air downward against the upper surface of the sheet of paper substantially at or along the center thereof are formed in the underside of the tube 38.

Control of the number of ports open is accomplished for example, by means of a plurality of slit tubes, or sleeves 52, 54 mounted on the air tube 38. These tubes are slit along the length thereof and can be rotated and slid along the tube such that the slits are out of registry with the jets or can be rotated to a position such as the jets are not covered by the slits. Thus, the air from selective jets can be controlled by means of the sleeves or tubes 52, 54. As shown for example in FIG. 3, the sleeves 52 and 54 are selectively rotated to a position to close off jets directly beneath the sleeves. Other jets not covered by the sleeves direct jets of air downward as shown by the arrows in FIG. 3 to provide a continuous force of air on the sheet. Thus, the position and number of jets acting downward on the surface of the sheet of paper can be controlled for control of the force on the sheet and control delivery of the paper. Similarly, the volume and force of flow of the air to the jets can be controlled by the adjustable valve 50 within the supply line.

With this arrangement, as a sheet of paper is entering the chute, the directional guide rollers 76 and brackets 78 support the edge of the sheet directing the sheet upward and substantially parallel to the chute angle so that the sheet does not drop down and drag across the surface of previous printed sheets. As the sheet enters the chute, the downward force of air (as will be seen in FIG. 4) forces the sheet to bend or bow downward about its longitudinal axis, thus preventing the sheet from bending about its transverse axis. In addition, this air system forces the sheet downward in the center, thereby intensifying the bows and utilizing the grain in the sheet of paper to full advantage by preventing the sheet from curling or tumbling as it enters the chute. The sheet then, as it clears the directional guide brackets, is supported by the jets of tubes 62 and 64 until forced downward out of the way of the next sheet by the continuous force of air from tube 58 and forced to rest on the bottom of the chute or on preceeding printed sheets in the chute. Thus, the paper moves quickly downward toward the bottom of the chute once it clears the lift guides. The air force can be adjusted to speed the movement of the sheet downward toward the bottom of the chute, thus forcing it to rapidly clear the path for the next succeeding sheet. Thus, the sheet is positively forced downward overcoming the support of the support jets in tubes 62 and 64. This forces the sheet immediately out of interference position with the next sheet coming into the chute. This increases the productive speed capability of the machine on which the device is attached.

The air force helps eliminate static build up as the air forces sheets to conform and overcome static resistance as it moves directly onto the surface of the preceeding sheet. With these attachments, it is not necessary to build up the bottom of the chute by placing a false bottom or block in the chute as was previously done to prevent downward curl of thin or moist sheets of paper. Thus, tumble of the paper in the chute is prevented, as well as permitting a greater number of sheets to be fit into the chute. In addition, as will be appreciated from viewing FIG. 4, the sheet moves downward with the center thereof bowed downward, the sides supported by air and are bowed upward permitting air to escape from beneath that sheet and between it and the preceeding sheet out the slits in the sides of the chute. The sheet is thus forced by the air into close nesting contact with the previous sheet, thus again preventing air from being trapped between the sheets and permitting greater numbers of sheets to be stacked in the chute. In addition, the air on the sheet cushions the next succeeding sheet as it comes through the chute. The term blast, as used herein, is intended to mean continuous stream of forced air rather than a sudden gust of air.

Another advantage of the system is that the air helps dry the printed surface faster since the air temperature is somewhat warmer than room temperature if the source of air, as contemplated is that of the exhaust system from the printing machine. The chute will hold more sheets of paper as the air forces printed sheets to lay flat, not permitting the paper to pile up to require more vertical height due to the paper curl or distortions from moisture, absorption and other problems.

An additional advantage of the present system is that alignment of the chute or tray with the sheet out of the machine is no longer as critical as with prior art systems. Sheets (e.g. 24, FIG. 4) coming out of the machine as much as one to two inches out of alignment with the tray, are delivered directly into the tray. The sheets side slip on the air support to the center of the tray. This permits adjustment of the image on the sheet (i.e. laterally) while the machine is running.

The air support system attachment is shown in combination with the air assist delivery of FIG. 1, previously described. In this air support system comprises a pair of support air tubes 62 and 64 each receiving air from a source 46 and includes a control valve 66 for controlling the air supply to the tubes 62 and 64 and the force of air applied thereby. The tubes each have air supply ports 68 (FIG. 7) for supplying air through the slots 18 and 20 in the sides of the chute 10 for supporting a sheet of paper supplied to the chute. These tubes 62 and 64 are adjustably supported such as by brackets 72 and 74 in the slots on the side walls of the tray or chute. These brackets permit the tubes 62 and 64 to be adjusted vertically along the side of the tray for adjusting the position of the tubes with respect to a paper 24 traveling into the chute or tray. Also, the angle of the jets from the tube can be adjusted about the axis of the tube, by rotating the tube, to direct the jets of air directly to selected positions adjacent and along the edges of the sheet 24 of paper (FIG. 4).

The angle of the jets can be indicated by the outer ends of the tubes, each respectively including an arm 62*a* and 64*a* wherein the jets are directly on the opposite side (at 180 degrees) of the tubes from the arms. The direction or angle of the arms with respect to the vertical side walls 12 and 14 on the tray 10 is an indicator of the angle of the jets.

The air jets from these tubes are selectively directed upward against the bottom adjacent and parallel to the edges of a sheet of paper traveling into the tray for thereby supporting the sheet of paper along its entire length as it passes into the tray. To adapt to higher speed operation, the initial supports for the sheet are freely rotating rollers 76 on arms 78. As soon as the paper passes beyond the feed rollers into the tray, the air from the upper tube 38 acting along the center axis thereof, forces the sheet to bow and move downward past the jets from the tube 62 and 64 into the bottom of the tray. This combination of force along the center axis and along the parallel opposed edges, bends or bows the sheet as shown in FIG. 4 forcing the sheet 24 to be supported in a generally cantilevered fashion outward from the rollers 76 and by the air cushion or platform formed by the jets from tubes 62 and 64.

Separate adjusting valve means 66 is provided for selectively adjusting the jets from tubes 62 and 64, so that adjusting the combination of these with respect to the force from the tube 38 thereby obtains optimum air flow support of sheets fed into the tray.

This combination provides continuous support for elongated sheets and for very thin sheets into the tray, thus preventing them from rolling or tumbling into the tray. In addition, it provides a more positive control of the sheets as they pass into the tray. Once the sheet passes downward beyond the upper end points of the jets from tubes 62, 64, the air from tube 38 forces the sheet with positive action against the floor of the tray or onto the sheets below.

It has been found that with this arrangement, the productive capacity of a typical machine can be increased by a range from 25% to 50% from about 5,000 sheets per hour delivered up to about 12,500 sheets per hour. The typical production rate is affected by sheet stock going through and the moisture content of the sheet. This positive control not only reduces the tendancy of the sheets to tumble into the tray, it also provides a positive and rapid delivery of the sheet to the bottom of the tray. This combination provides for more rapid production from a machine. In addition, the air flow has been found to reduce the static build up on the sheets of paper to permit the more fluid bundle of sheets to be provided. In addition, the air flow provides a cushion between the sheets and also provides a drying affect on the sheets.

Due to the sloping slots 20 the tubes 62 and 64 are preferably telescoping two part sleeves with a telescoping section 65 between the two sets of slots of each side thereof. This permits adjustment of the tubes to permit them to telescope inward and outwardly to maintain alignment with the sloped or angled slots.

With this combination of air flow control features, a machine of the multilith duplicating type can process papers known in the trade as "penalty papers" much easier and more rapidly than before. Such penalty papers are normally of the unusual type in thickness such as very light, thin papers, very long papers, cardboards and other very unusual variations from known standard sheets of paper. This positive control with air platform support and air bowing of the sheet as it travels out above the tray provides a very highly effective positive control of the delivering of papers into the tray. The improved capacity of the machine may require the use of a tray having a receding bottom 10 as depicted in FIG. 4.

It is contemplated that the present system can be utilized with any sheet delivery and stacking system. For example, it can be used with chain delivery systems, i.e. where sheets are pulled out of a printing machine by chain carried grippers. Air support at the edges and downward air force at the center of the sheets can be achieved by proper placement of the air jet system. Moreover, this air control system can even replace the chain drive in many instances.

Some machines utilize a one or more star wheels or rollers for engaging the upper surface of the sheet as it exits from the machine to help prevent the sheet from crimping when being directed toward the chute. A typical arrangement utilizes a long pull out roller 25 with a pair of thin wheels or rollers 27 at the ends of the roller 25 to engage the edge of the sheet to help pull it out. One or more star wheels or rollers may be positioned between these wheels to force the center of the sheet downward to either bow it about its longitudinal axis for support or a transverse axis to permit change of direction without crimping. These, however, tend to leave marks or smear freshly printed paper.

Figure 3:
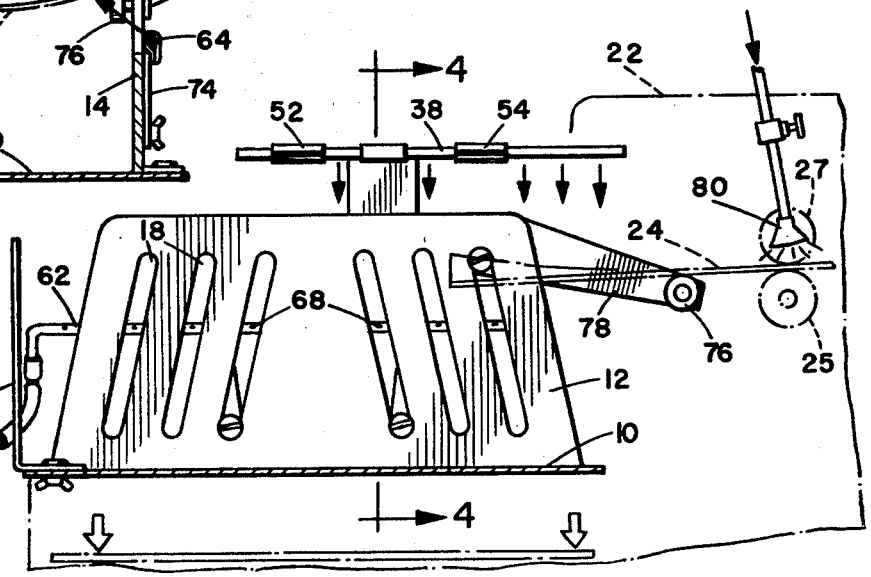
FIG. 3 is a sectional view taken on line 3—3 of FIG. 2.

In FIG. 3, I illustrate an air nozzle 80 for forcing the sheet down and supporting it at this point to eliminate rollers and star wheels. This force of air eliminates the smearing of the rollers and star wheels of the prior art construction. The nozzle is preferably fan shaped with a narrow fan shaped jet of air.

While the present invention has been illustrated and described by means of a specific embodiment, it is to be understood that numerous changes and modifications can be made therein without departing from the spirit and scope of the invention as defined in the appended claims. For example, the air assist or jets can be used in conjunction with other types of delivery systems such as chain delivery systems. In such systems the sheet is pulled from the machine by grippers on chains and simply released to fall by gravity onto a stack. With such systems only the jets disposed substantially directly above the sheet when released is all that is required. The lift guides are not believed essential in these systems.

Having described my invention, I now claim:

1. A sheet stacking system comprising in combination:

a sheet receiving chute disposed for receiving individual flat rectangular sheets moving in succession from a machine;

air support means including a plurality of upwardly directed air support jets disposed at each side of said chute for engaging the underside of the sheet along the side edges thereof for supporting a sheet during movement of the sheet into the chute; and air pressure means for applying a continuous force on the upper surface along the center longitudinal axis of said sheet while said sheet is supported by said air support means during delivery into said chute for bending said sheet about its longitudinal axis for providing longitudinal support thereof and for rapidly forcing said sheet downwardly into said chute out of the way of succeeding sheets.

2. The sheet delivery system of claim 1 wherein air pressure means comprises a jet of air directed at said sheet from above.

3. The sheet delivery system of claim 2, wherein said jet of air is adjustable for adjusting the force on said sheets.

4. The sheet delivery system of claim 1 wherein said pressure means comprises a plurality of air directed against said sheet from above.

5. The sheet delivery system of claim 4, wherein said plurality of jets are formed in a tube extending along the axis of and above said chute.

6. The sheet delivery system of claim 5, incuding at least one sleeve rotatably and slidably mounted on said tube for selectively covering one or more of said jets.

7. The sheet delivery system of claim 1 wherein said air support jets are adjustably mounted on the sides of said chute.

8. The sheet delivery system of claim 7, wherein said jets are formed in tubes that are adjustable for adjusting the height of said jets on the sides of said chute.

9. The sheet delivery system of claim 5 wherein said chute includes a receeding bottom that moves downward away from the position from which the sheets are being delivered.

10. The sheet delivery system of claim 2 wherein said air support means includes jets of air directed along the axis of said sheets and adjustable toward and away from the side edges thereof.

11. The sheet delivery system of claim 10 wherein said air support jets are formed in conduits extending along the edges of the tray and are adjustable by rotation of said conduits.

12. A sheet stacking system comprising in combination:

a sheet receiving chute disposed for receiving individual flat rectangular sheets moving in succession from a machine;

air support means including air support jets formed in conduits extending along the edges of the tray directed along parallel to the axis of said sheets and adjustable by rotation of said conduits toward and away from the side edges thereof for supporting the side edges of a sheet during movement of the sheet into the chute; and air pressure means comprising a jet of air for applying a force on the upper surface substantially along the center longitudinal axis of said sheet while said sheet is supported by said air support means during delivery into said chute for bending said sheet about its longitudinal axis for providing longitudinal support thereof and for rapidly forcing said sheet into said chute out of the way of succeeding sheets, said chute includes sidewalls having vertical slots and said jets are positioned to direct air through said slots.

* * * * *